US009999341B1

(12) United States Patent
Kelly, Sr.

(10) Patent No.: US 9,999,341 B1
(45) Date of Patent: Jun. 19, 2018

(54) FOOTWEAR-CLEANING DEVICE

(71) Applicant: Douglas Kelly, Sr., Port Charlotte, FL (US)

(72) Inventor: Douglas Kelly, Sr., Port Charlotte, FL (US)

( * ) Notice: Subject to any disclaimer, the term of this patent is extended or adjusted under 35 U.S.C. 154(b) by 437 days.

(21) Appl. No.: 14/842,244

(22) Filed: Sep. 1, 2015

(51) Int. Cl.

| | |
|---|---|
| ***A47L 23/02*** | (2006.01) |
| ***A47L 23/26*** | (2006.01) |
| ***A46B 11/06*** | (2006.01) |
| ***A46B 11/00*** | (2006.01) |

(52) U.S. Cl.
CPC ..... *A47L 23/26* (2013.01); *A46B 11/0079* (2013.01); *A46B 11/063* (2013.01); *A47L 23/266* (2013.01)

(58) Field of Classification Search
CPC .... A47L 23/26; A47L 23/266; A46B 11/0079; A46B 11/063
See application file for complete search history.

(56) References Cited

U.S. PATENT DOCUMENTS

| | | | | |
|---|---|---|---|---|
| 3,100,312 | A | 8/1963 | Williams | |
| 5,077,858 | A | 1/1992 | Armiento | |
| D375,039 | S | 10/1996 | Carroll | |
| 6,074,490 | A | 6/2000 | Brown | |
| 6,584,636 | B2 * | 7/2003 | Schlem | A47L 23/02 15/104.92 |
| 7,930,789 | B2 | 4/2011 | Hollander | |
| 9,084,514 | B1 * | 7/2015 | Elswick | A47K 7/03 |
| 2014/0196235 | A1 | 7/2014 | Nappi, Sr. | |

FOREIGN PATENT DOCUMENTS

| | | | |
|---|---|---|---|
| WO | WO2000044260 | A1 | 8/2000 |

* cited by examiner

*Primary Examiner* — Shay Karls

(57) ABSTRACT

The footwear-cleaning device is a device that is adapted to clean footwear via the use of a compressed air source and/or a pressurized water source. The footwear-cleaning device is an accessory that is attached downstream of or integrated into an air or water supply. The footwear-cleaning device has at least one stationary brush that protrudes perpendicular from the base of the accessory unit. A manually operated on/off valve regulates the passing of either compressed air or water under pressure into at least one tubular hose, which feeds into at least one stationary brush. The at least one stationary brush is attached to the base of the unit. The manually operated on/off valve is engaged and disengaged via a removable handle that is positioned perpendicular to the base of the unit as it sits on the ground.

3 Claims, 6 Drawing Sheets

FOOTWEAR-CLEANING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shoe maintenance, more specifically, an accessory configured to clean shoes.

SUMMARY OF INVENTION

The footwear-cleaning device includes an accessory that is attached downstream of or integrated into an air or water supply. The footwear-cleaning device has at least one stationary brush that protrudes perpendicular from the base of the accessory unit. Moreover, the footwear-cleaning device has a manually operated on/off valve that regulates the passing of either compressed air or water under pressure into at least one tubular hose that feeds into at least one stationary brush that is attached to the base of the unit. Furthermore, the manually operated on/off valve is engaged and disengaged by a removable handle that is positioned perpendicular to the base of the unit as it sits on the ground.

It is the object of the invention to provide an accessory that uses either forced air or water under pressure in conjunction with at least one stationary brush for the purpose of cleaning footwear.

These together with additional objects, features and advantages of the footwear-cleaning device will be readily apparent to those of ordinary skill in the art upon reading the following detailed description of the presently preferred, but nonetheless illustrative, embodiments when taken in conjunction with the accompanying drawings.

In this respect, before explaining the current embodiments of the footwear-cleaning device in detail, it is to be understood that the footwear-cleaning device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the footwear-cleaning device.

It is therefore important that the claims be regarded as including such equivalent construction insofar as they do not depart from the spirit and scope of the universal shoe cleaner. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
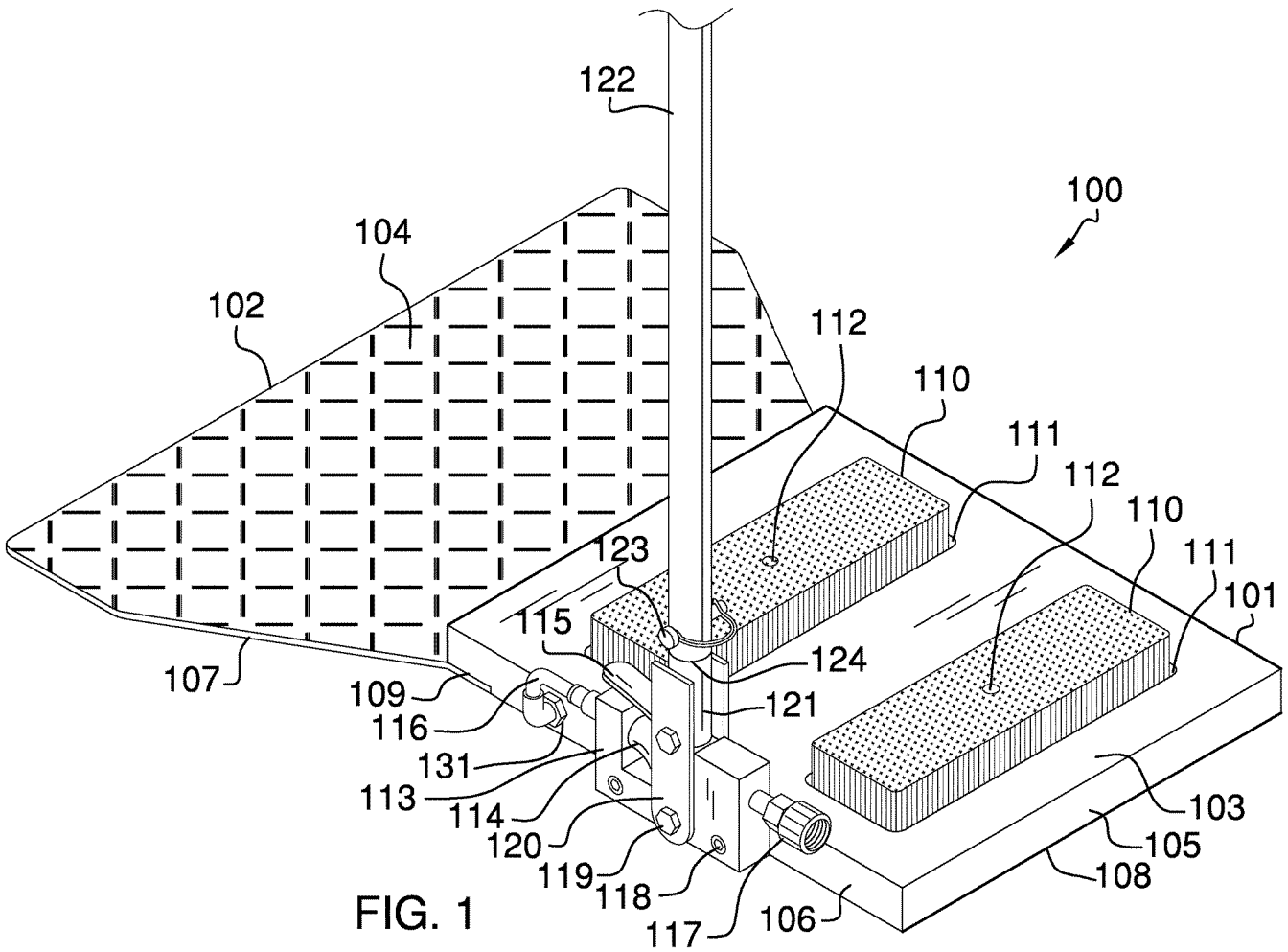
FIG. 1 is an expanded, perspective view of an embodiment of the disclosure.
Figure 2:
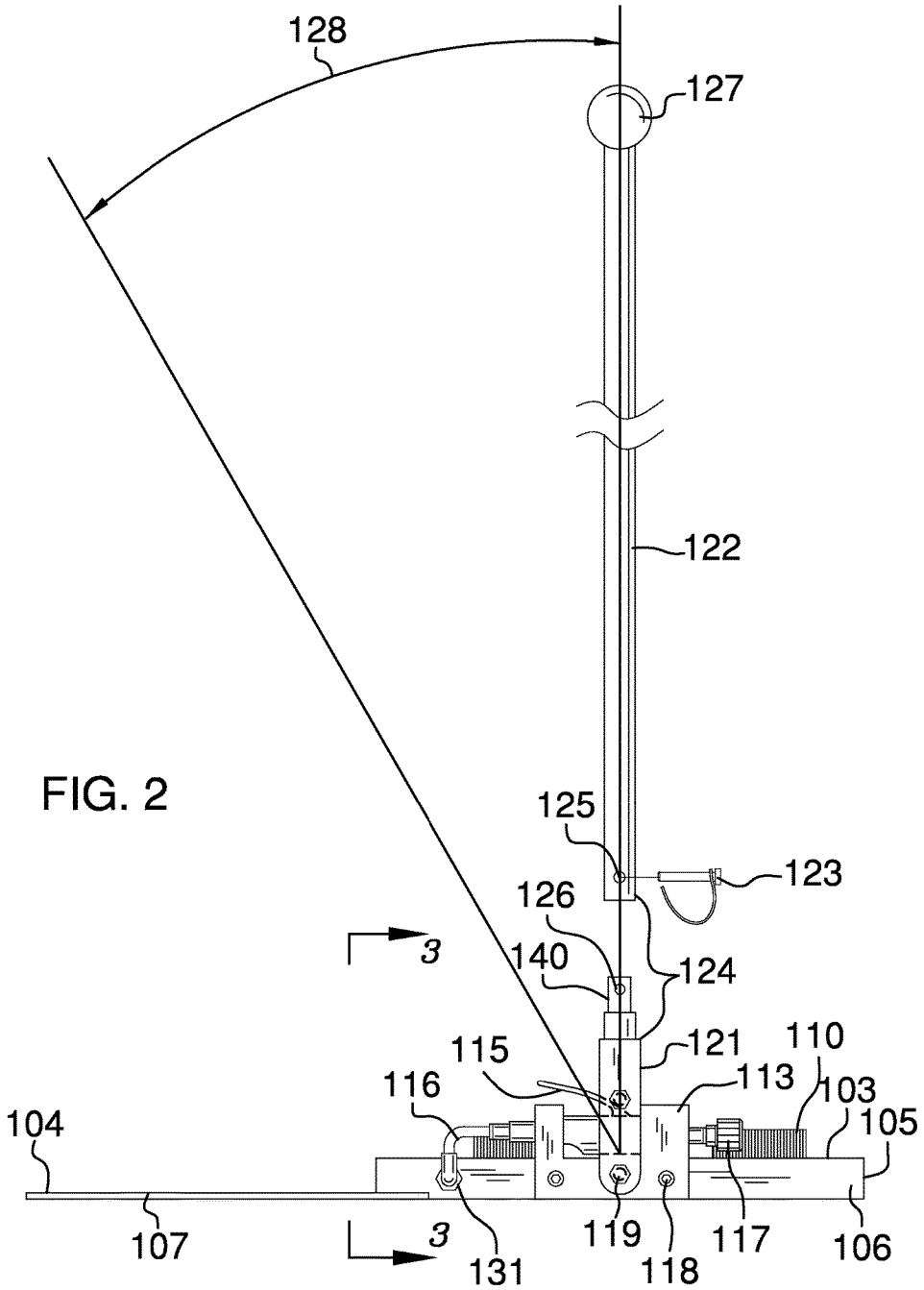
FIG. 2 is a front view of an embodiment of the disclosure.
Figure 3:
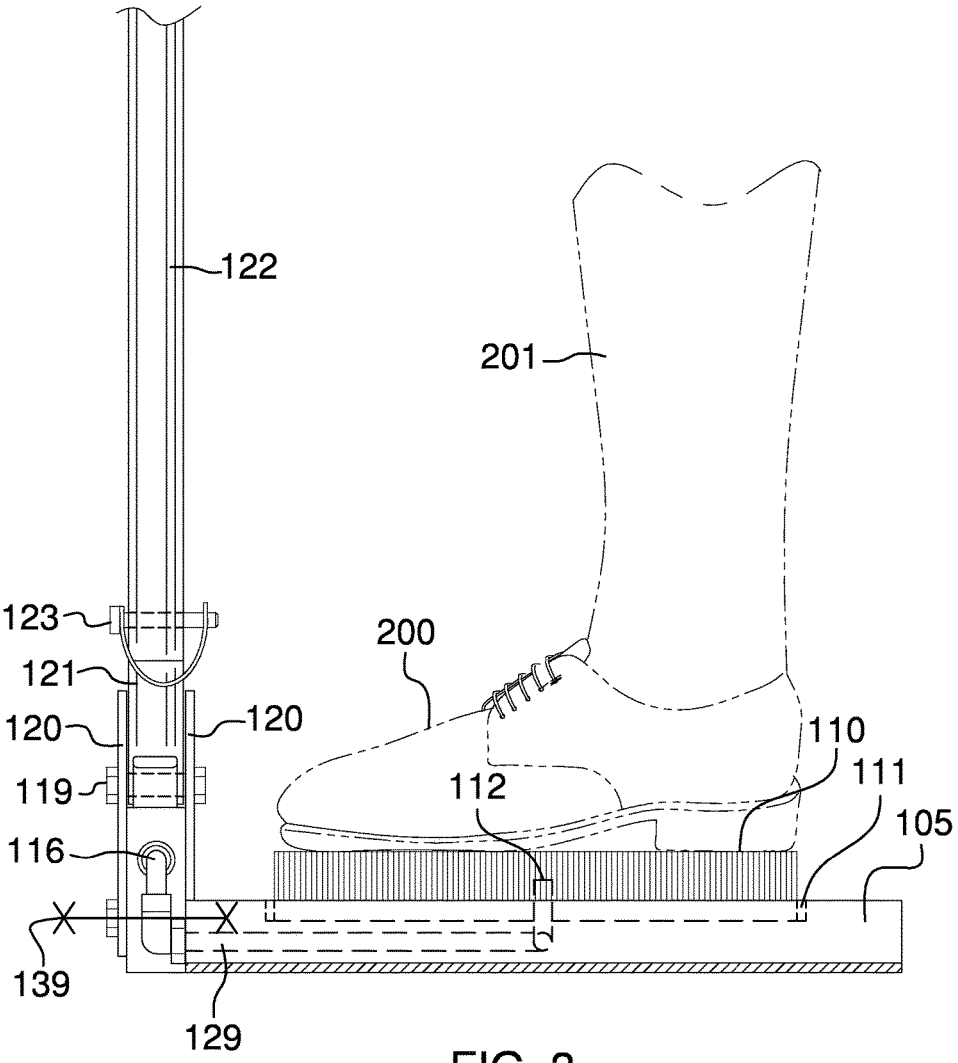
FIG. 3 is a side view of an embodiment of the disclosure along line 3-3 in FIG. 2.
Figure 4:
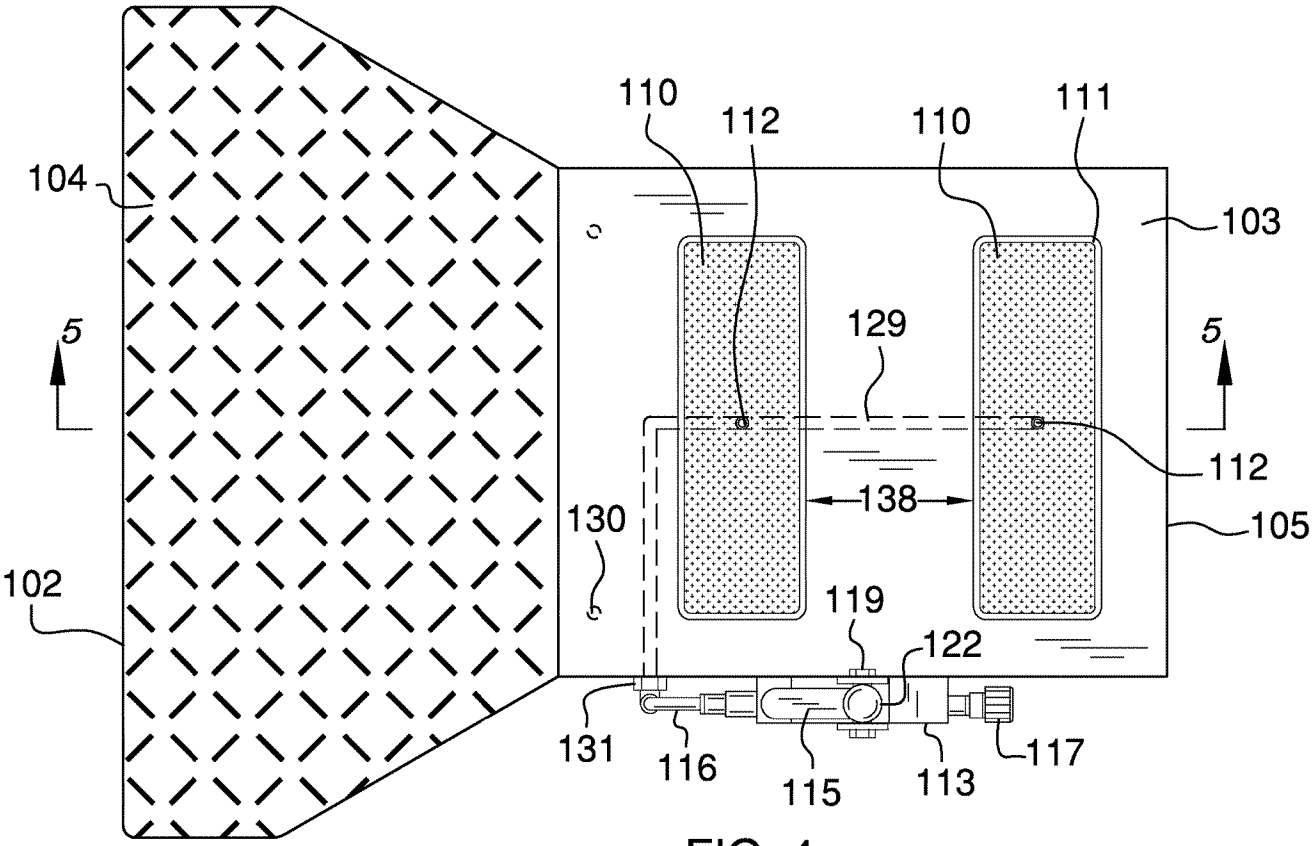
FIG. 4 is a top view of an embodiment of the disclosure.
Figure 5:
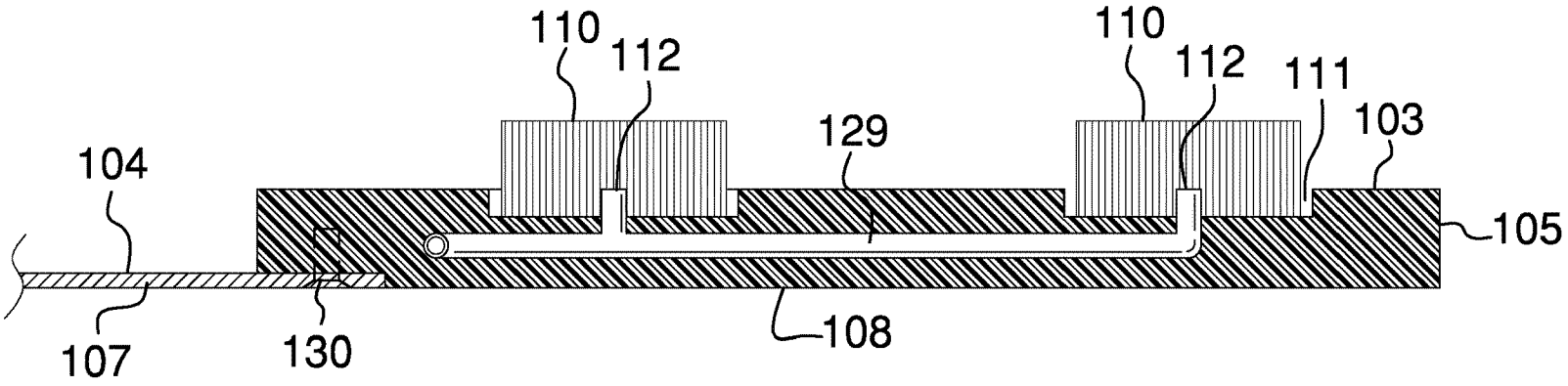
FIG. 5 is a cross-sectional view of an embodiment of the disclosure along line 5-5 in FIG. 4.
Figure 6:
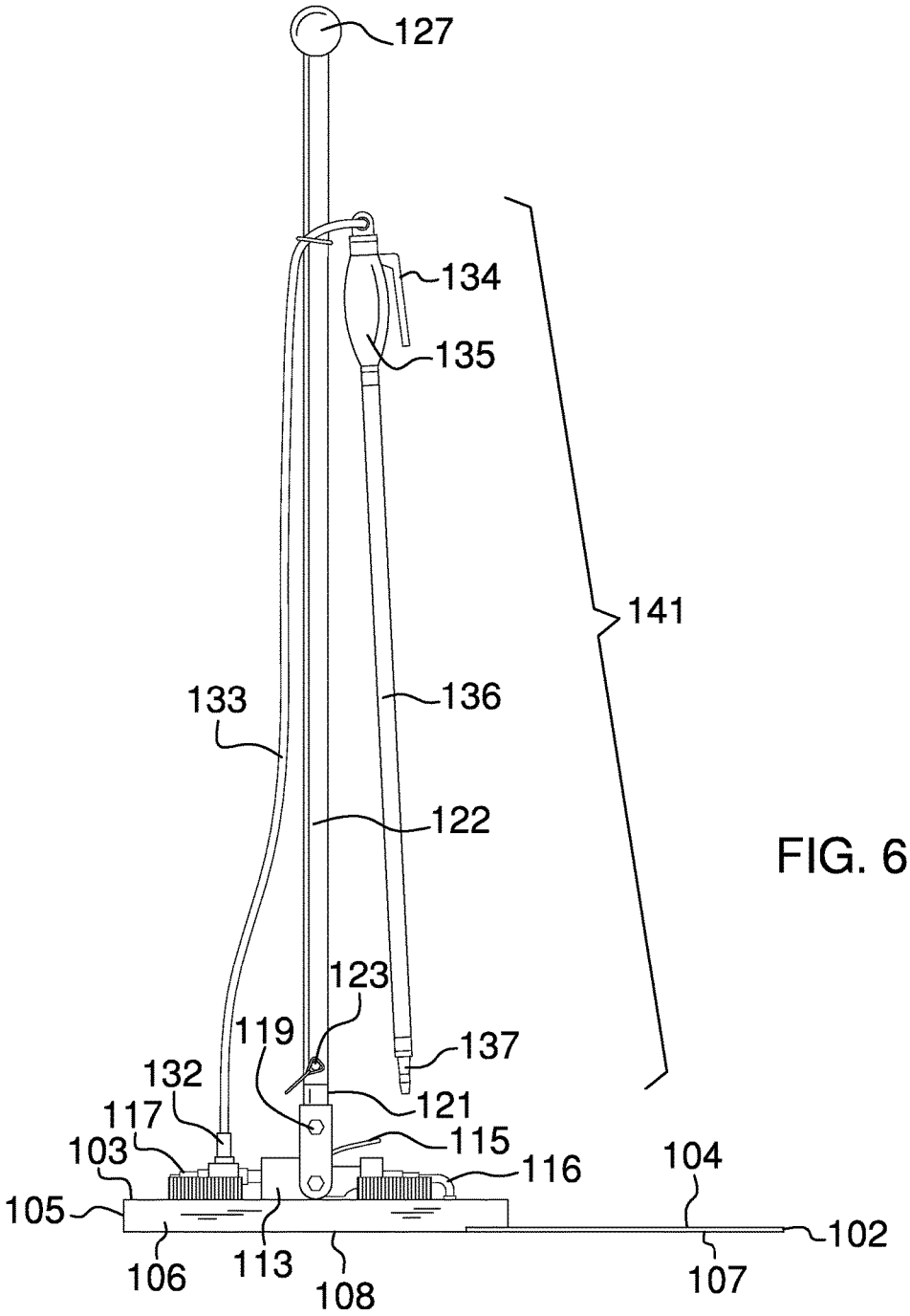
FIG. 6 is a rear view of an embodiment of the disclosure in use.

Detailed reference will now be made to a first potential embodiment of the disclosure, which is illustrated in FIGS. 1 through 6. The footwear-cleaning device 100 (hereinafter invention) is further defined with a first base 101 and a second base 102. The second base 102 is constructed of diamond-plated sheet metal that is fastened to the bottom of first base 108 at a point 109 in the bottom of the first base 101 with a fastener 130. The fastener 130 comprises the use of a rivet, bolt, or screw 130. The area of the second base 102 is dimensionally greater than or equal to the size of the first base 101 when viewed from the top view.

The first base 101 may be the same or of different material than the second base 102. The first base 101 is rectangular in shape with a top surface 103, a bottom surface 108, a front surface 106, and a side surface 105. The top surface 103 of the first base 101 has a plurality of rectangular recesses 111. The plurality of rectangular recesses 111 are separated from one another via a distance 138, which is at least one inch apart. The plurality of rectangular recesses 111 on the top surface 103 of the first base 101 enable at least one brush 110 to be secured therein. The at least one brush 110 is oriented to the top of the first base 103 so that brush bristles of each of the at least one brush 110 are facing upwards, perpendicular to the first base 101 as it rests on the ground.

Each of the at least one brush 110 has at least one perforation 112 for a plurality of tubular hoses 129 to protrude from inside of the first base 101 so that the respective one of the plurality of tubular hoses 129 is unobstructed within the at least one brush 110. The at least one brush 110 is adapted to receive an article of footwear 200 thereon, and which is able to brush said article of footwear 200. Said article of footwear 200 may be worn via a user 201 whilst being cleaned via the at least one brush 110.

The at least one tubular hose 129 is in fluid communication with a hose fitting 131 located on the first base 106. The hose fitting 131 is attached to another tubular hose 116 that is part of, or affixed to a manually operated on/off valve 114. The manually operated on/off valve 114 is encased in a housing 113. The housing 113 being provided adjacent to the first base 106. Moreover, the housing 113 is secured to the first base 106 via a second fastener 118, which comprises the use of at least one bolt, rivet, or screw.

The manually operated on/off valve 114 is in fluid communication with a hose connection 117. The hose connection 117 is adapted to be joined with a supply line that sources either compressed air or water under force. The manually operated on/off valve 114 has a lever 115 which proportionally allows either compressed air or water under force to be supplied to the tubular hose 116 located on the first base 106, which connects to at least one tubular hose 129 via a fitting 131. The compressed air or water under pressure is dispensed through the at least one perforation 112 located within the bristles of at least one brush 110.

The lever 115 located on the manually operated on/off valve 114 is activated when the lower portion of the handle 121 is moved on an axis 139 by the upper portion of the handle 122 at an angle 128 so that a third fastener 119 located on the lower portion of the handle 121 causes the lever 115 to be pressed. The third fastener 119 comprises the use of a rivet, screw, bolt. The pressing of the lever 115 causes the manually operated on/off valve 114 to introduce either compressed air or water through the tubular hose 116, and to the at least one brush 110.

The upper portion of the handle 122 and lower portion of the handle are both tubular in shape, sitting perpendicular from the base as it sits on the ground. The lower portion of the handle 121 is fixed to the housing 113 of the manually operated on/off valve 114 via at least one rectangular metal plate 120 with the third fastener 119. The lower portion of the handle 122 is tapered 140 so that the upper portion of the handle 122 can fit over the tapered portion 140 to a joining point 124. The upper handle has a hole 125 that lines up with a hole 126 in the lower handle 121 when they are fitted together. A quick release pin 123 is placed through both holes when the upper handle 122 and lower handle 121 are joined together so that they remain secured to the unit.

An auxiliary air wand 141 can be added to the invention 100, and operated in addition to the aforementioned forms and functions of the invention 100. In doing so, an air hose 133 is joined to the tubular hose 116 via a t-shaped fitting 132. The t-shaped fitting is oriented in the system so that when the hand operated on/off valve 114 is activated, air is supplied to both the air wand 141 and at least one perforation 112 within the at least one brush 110. The air wand 141 has its own hand operated on/off valve 135 that is activated by pressing a lever 134 manually. The activation of the lever 134 on the air wand 141 sends air through a tubular extension 136 that has a tapered tip 137. The air flow that is exits through the auxiliary air wand 141, more specifically through the tapered tip 137 allows for a concentrated force of air to aid in the footwear-cleaning process.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A footwear-cleaning device comprising:

a first base and a second base;

wherein at least one brush is in communication with a compressed air or pressurized water, which is dispensed there from;

wherein the at least one brush is adapted to receive an article of footwear in order to clean said article of footwear in conjunction with the compressed air or pressurized water;

wherein the second base is fastened under the first base at a point in the bottom of the first base with a fastener;

wherein the area of the second base is greater than or equal to the area of the first base when viewed from above;

wherein the first base is rectangular in shape, and is further defined with a top surface, a bottom surface, a front surface, and a side surface;

wherein the top surface of the first base has a plurality of rectangular recesses;

wherein the plurality of rectangular recesses are separated from one another via a distance;

wherein the distance is at least one inch apart;

wherein the plurality of rectangular recesses on the top surface of the first base enable the at least one brush to be secured therein;

wherein the at least one brush is oriented to the top of the first base so that brush bristles of each of the at least one brush are facing upwards, perpendicular to the first base as it rests on a ground surface;

wherein each of the at least one brush has at least one perforation for a plurality of tubular hoses to protrude from inside of the first base so that the respective one of the plurality of tubular hoses is unobstructed within the at least one brush;

wherein an at least one tubular hose is in fluid communication with a hose fitting located on the first base;

wherein the hose fitting is attached to another tubular hose that is part of, or affixed to a manually operated on/off valve;

wherein the manually operated on/off valve is encased in a housing;

wherein the housing is adjacent to the first base;

wherein the housing is secured to the first base via a second fastener;

wherein the manually operated on/off valve is in fluid communication with a hose connection;

wherein the hose connection is adapted to be joined with a supply line that sources said compressed air or pressurized water;

wherein the manually operated on/off valve has a lever that proportionally allows either compressed air or pressurized water to be supplied to the tubular hose located on the first base, and which connects to at least one tubular hose via a fitting;

wherein the compressed air or pressurized water is dispensed through the at least one perforation located within the brush bristles of at least one brush;

wherein the lever located on the manually operated on/off valve is activated when the lower portion of the handle is moved on an axis by the upper portion of the handle at an angle so that a third fastener located on the lower portion of the handle causes the lever to be pressed;

wherein upon pressing of the lever causes the manually operated on/off valve to introduce either compressed air or pressurized water through the tubular hose, and to the at least one brush;

wherein the upper portion of the handle and lower portion of the handle are tubular in shape, sitting perpendicular from the base as it sits on the ground;

wherein the lower portion of the handle is fixed to the housing of the manually operated on/off valve via at least one rectangular metal plate with the third fastener;

wherein the lower portion of the handle is tapered so that the upper portion of the handle fits over the tapered portion to a joining point; wherein the upper handle has a hole that lines up with a hole in the lower handle when they are fitted together; wherein a quick release pin is placed through both holes when the upper handle and lower handle are joined together so that they remain secured together.

2. The footwear-cleaning device as described in claim 1 wherein an auxiliary air wand is included; wherein an air hose is joined to the tubular hose via a t-shaped fitting; wherein the air wand is further defined with a hand operated on/off valve that is activated by pressing a lever manually.

3. The footwear-cleaning device as described in claim 2 wherein activation of the lever on the air wand sends compressed air through a tubular extension that has a tapered tip.

* * * * *